US008035530B2

(12) United States Patent
Ramasubbu

(10) Patent No.: US 8,035,530 B2
(45) **Date of Patent: *Oct. 11, 2011**

(54) RFID INTELLIGENT TRAFFIC SIGNALING

(76) Inventor: Sridhara Subbiah Ramasubbu, Clarksville, MD (US)

( * ) Notice: Subject to any disclaimer, the term of this patent is extended or adjusted under 35 U.S.C. 154(b) by 291 days.

This patent is subject to a terminal disclaimer.

(21) Appl. No.: 12/475,705

(22) Filed: Jun. 1, 2009

(65) Prior Publication Data

US 2009/0231160 A1 Sep. 17, 2009

Related U.S. Application Data

(63) Continuation-in-part of application No. 11/558,178, filed on Nov. 9, 2006, now Pat. No. 7,557,731.

(51) Int. Cl.
*G08G 1/08* (2006.01)

(52) U.S. Cl. ..... 340/922; 340/572.4; 340/917; 340/941

(58) Field of Classification Search ..... 340/916, 340/917, 922, 933, 941, 572.1, 572.4, 572.8
See application file for complete search history.

(56) References Cited

U.S. PATENT DOCUMENTS

| | | | | |
|---|---|---|---|---|
| 5,917,432 | A * | 6/1999 | Rathbone | 340/917 |
| 2004/0189493 | A1 * | 9/2004 | Estus et al. | 340/988 |
| 2005/0278082 | A1 * | 12/2005 | Weekes | 340/438 |
| 2006/0017587 | A1 * | 1/2006 | Park et al. | 340/988 |
| 2006/0202862 | A1 * | 9/2006 | Ratnakar | 340/933 |

* cited by examiner

*Primary Examiner* — Thomas Mullen
(74) *Attorney, Agent, or Firm* — Louis Ventre, Jr.

(57) ABSTRACT

A system and method for regulating the flow of traffic at a roadway intersection having one or more traffic signals by positioning a processor in the vicinity of the intersection to store cycle times of the traffic flow directions, mounting an RFID reader in the vicinity of each traffic signal in communication with the processor, interrogating with the RFID reader an RFID tag on each RFID-tagged vehicle at the roadway intersection to count the number of RFID-tagged vehicles present in each traffic flow direction at the roadway intersection, calculating an unused time slice of the cycle time for a first traffic flow direction at the intersection; reducing the cycle time for the first traffic flow direction in accordance with the unused time slice; and, increasing the cycle time for a second traffic flow direction at the intersection in accordance with the unused time slice.

8 Claims, 4 Drawing Sheets

RFID INTELLIGENT TRAFFIC SIGNALING

CROSS-REFERENCE TO RELATED APPLICATIONS

This application is a continuation-in-part of application Ser. No. 11/558,178, filed 9 Nov. 2006, now U.S. Pat. No. 7,557,731, which is hereby incorporated by reference herein.

TECHNICAL FIELD

In the field of electrical communications, a method and system employing a traffic control indicator normally under a local controller that is responsive to a traffic detector wherein the number of vehicles detected in an area determines the percentage of a complete cycle allowed for a particular indicator phase.

BACKGROUND ART

Automobiles are a part of everyday life in urban and suburban communities. Traffic lights dot the landscape in urban centers and the surrounding communities, and control the flow of traffic on roads, large and small. Drivers must pay attention to traffic signals, and failure to heed them, results in increased traffic congestion and accidents.

While traffic controls are a necessary part of any road and highway system, measures are taken to try to keep the traffic flow on the major arteries moving as much as possible.

SUMMARY OF INVENTION

A system and method for regulating the flow of traffic at a roadway intersection involves positioning a processor in the vicinity of the traffic signal controlled intersection. The processor is configured to store adaptable cycle times for the traffic signal. A Radio-frequency Identification (RFID) reader is mounted in the vicinity of the traffic signal, which communicates with the processor and interrogates an RFID tag on each RFID-tagged vehicle at the roadway intersection. The RFID reader in combination with the processor counts the number of RFID-tagged vehicles present in each traffic flow direction at the roadway intersection. The processor is configured to calculate an unused time slice of the cycle time for a first traffic flow direction at the roadway intersection and reduce the cycle time for the first traffic flow direction in accordance with the unused time slice. The processor is also configured to increase the cycle time for a second traffic flow direction at the roadway intersection in accordance with the unused time slice.

TECHNICAL PROBLEM

Traffic congestion is a widespread problem. There is a recognized need for more efficient control of traffic at intersections. Efficient traffic control is becoming an urgent necessity that affects traveler stress, vehicle energy consumption, and vehicle pollution due to unnecessary vehicle idling and travel time. These consequences, when cumulated by the gross number of cars, contribute to nationally significant financial costs, environmental pollution and energy consumption figures.

SOLUTION TO PROBLEM

A traffic control method and system intelligently switches a traffic signal utilizing an unused time slice. This is achieved by using a processor and an RFID reader to interrogate an RFID vehicle tag of vehicles stopped at a traffic signal controlled roadway intersection, wherein the processor calculates the signaling time more efficiently.

ADVANTAGEOUS EFFECTS OF INVENTION

This invention improves upon conventional traffic signaling, including traffic related smart systems, in that it permits checking vehicle density and individual vehicle identification before during and after signal switching. It is also distinctive in that the unused time slice authorizing travel in any direction may be allocated to the most wanted direction, not to the next signal in sequence.

Managing the efficiency of a traffic signal controlled intersection can be achieved by utilizing an unused time slice in a lighting sequence or cycle of the traffic signal. The unused time slice occurs when there are too few vehicles to fully utilize the allotted cycle time slice. When too few vehicles are detected either at or approaching the intersection, the unused time slice is awarded to the more populated traffic flow direction based on this invention. This invention ensures the safety of vehicles with a capability to calculate sufficient time for the oncoming vehicles to stop at the time of switching.

The processor is installed locally to the traffic signal and may be configured to interact with the other traffic signal processors at other intersections so that the traffic signal operation can be coordinated.

The invention enables tracking a vehicle in the absence of GPS or a cell phone and is particularly effective when the RFID tag is affixed to the license plate because vehicles are expected to have license plates and those without license plates would immediately arouse suspicion.

Risky traffic violations like running a red light can be detected and the owner identified by automatically reading the RFID tag on the vehicle. The owner can then be ticketed and called to account for the violation.

RFID readers fitted to law enforcement vehicles could easily download information from the system on vehicles under suspicion even in the absence of wireless connection and satellite communication.

Priority data, according to the invention, is a code or numbering assigned to an RFID tag, preferably fitted to the license plate by the motor vehicle administration or department of motor vehicles. This priority data can then be read by an RFID reader installed at the traffic signal to judge the importance or authorized priority of a vehicle waiting for the signals so that the traffic signal may be changed accordingly. For example, the priority of the RFID device affixed to a license plate fitted to the vehicles can be analyzed by the processor to give right of way to emergency vehicles, like ambulance and law enforcement vehicles.

Additional information stored in an RFID tag, preferably fitted to a license plate by a state Motor Vehicle Agency (MVA) or Division of Motor Vehicles (DMV) could also be used to track vehicle movements without using the Global Positioning System (GPS) or a cell phone tracking system.

BRIEF DESCRIPTION OF DRAWINGS

The drawings show preferred embodiments of the invention and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

Figure 1:
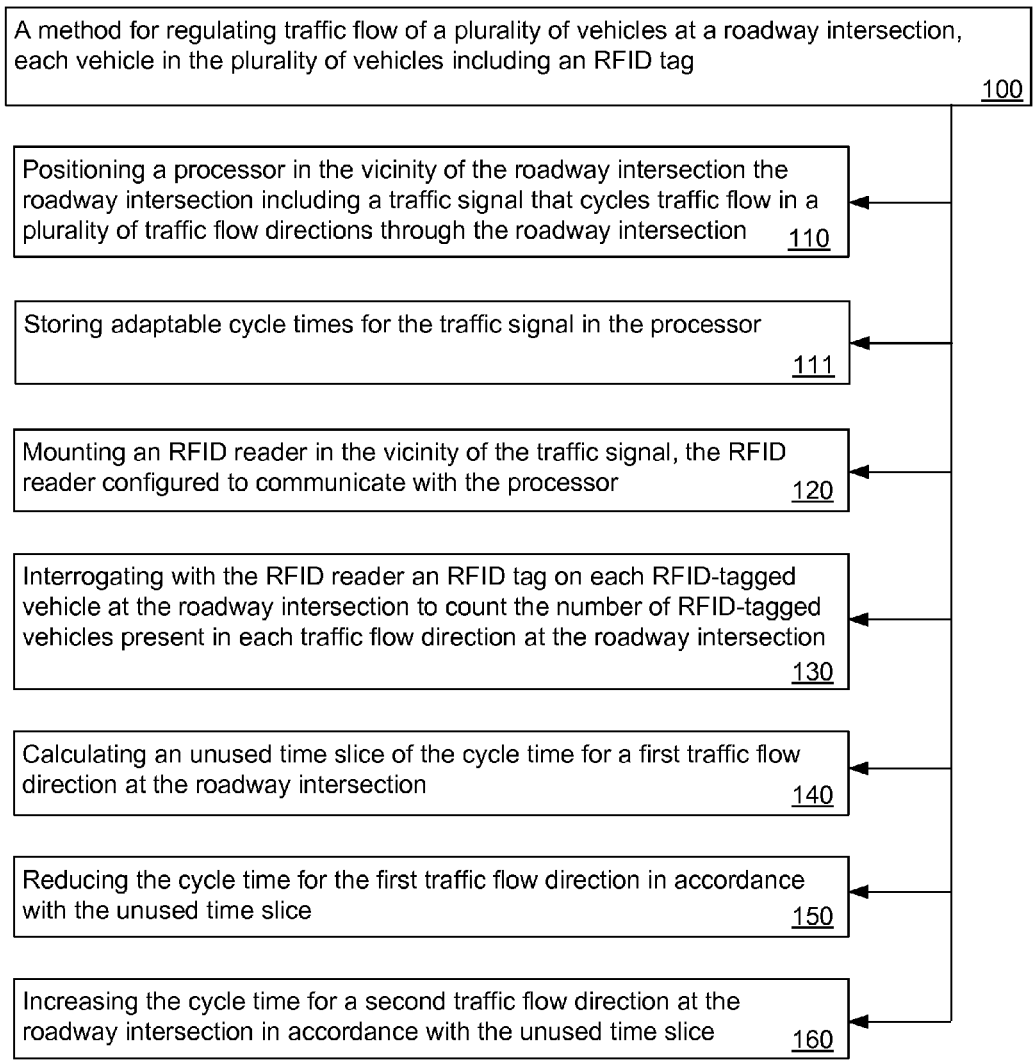
FIG. 1 is a diagram of the steps of a preferred method of the invention.

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention. For example, the steps in the method of the invention may be performed in any order that results in regulating the flow of traffic in accordance with the invention. Solid lines in the drawings generally indicate necessary steps and dashed lines indicate optional steps.

Regarding FIG. 1, a preferred embodiment of the process of the invention is a method for regulating the flow of traffic at a roadway intersection (100). This preferred method comprises a first step (110) of positioning a processor in the vicinity of the roadway intersection said roadway intersection comprising a traffic signal that cycles traffic flow in a plurality of traffic flow directions through the roadway intersection. The processor is configured to store adaptable cycle times for the traffic signal. Thus, the method may include a step of storing adaptable cycle times for the traffic signal on the processor (111).

The processor is preferably positioned anywhere at or near the intersection in order that the component parts of the invention be contained in close proximity to each other so as to be serviceable at the intersection.

In many circumstances, there would be a plurality of traffic signals at the intersection and all will be maintained under the control of the processor. The processor is configured with computer memory to, at a minimum, store the normal or default cycle times for the traffic signals at the intersection. The computer memory is typically configured store the programming needed to make the necessary calculations and implement switching the traffic signals. The computer memory may also store related data incident to the operation of the invention, such as law enforcement or other emergency vehicle identification data that can be used to grant signaling priority in the direction those vehicles are travelling.

This preferred method comprises a second step (120) of mounting an RFID reader in the vicinity of the traffic signal, wherein the RFID reader is configured to communicate with the processor. Preferably, there is an RFID reader in each direction of travel through the intersection so as to add confidence that all RFID-tagged vehicles are counted.

This preferred method comprises a third step (130) of interrogating with the RFID reader an RFID tag on each RFID-tagged vehicle at the roadway intersection to count the number of RFID-tagged vehicles present in each traffic flow direction at the roadway intersection. The count of vehicles within or approaching each travel direction through the intersection enables the processor to determine if there is an unused time slice for travel in that direction.

This preferred method comprises a fourth step (140) of calculating an unused time slice of the cycle time for a first traffic flow direction at the roadway intersection. The processor typically takes the count of vehicles in each travel direction through the intersection and then calculates any unused time slice.

This preferred method comprises a fifth step (150) of reducing the cycle time for the first traffic flow direction in accordance with the unused time slice. When an unused time slice exists, the processor then eliminates the excess and unneeded time period for that cycle.

This preferred method comprises a sixth step (160) of increasing the cycle time for a second traffic flow direction at the roadway intersection in accordance with the unused time slice. Since the excess and unneeded time period is eliminated, the process must then correspondingly increase the cycle time for another direction at the intersection. In some cases, there will only be one other direction of travel, and in that case, for that direction, the traffic signal is switched to green. If there is more than one other direction of travel through the intersection, then the processor preferably selects the direction having more vehicles waiting to pass through the intersection or makes a selection based on other programmed priorities, such as whether or not the cars can proceed through the next intersection or would be backed up by heavy traffic waiting at the next intersection.

Figure 2:
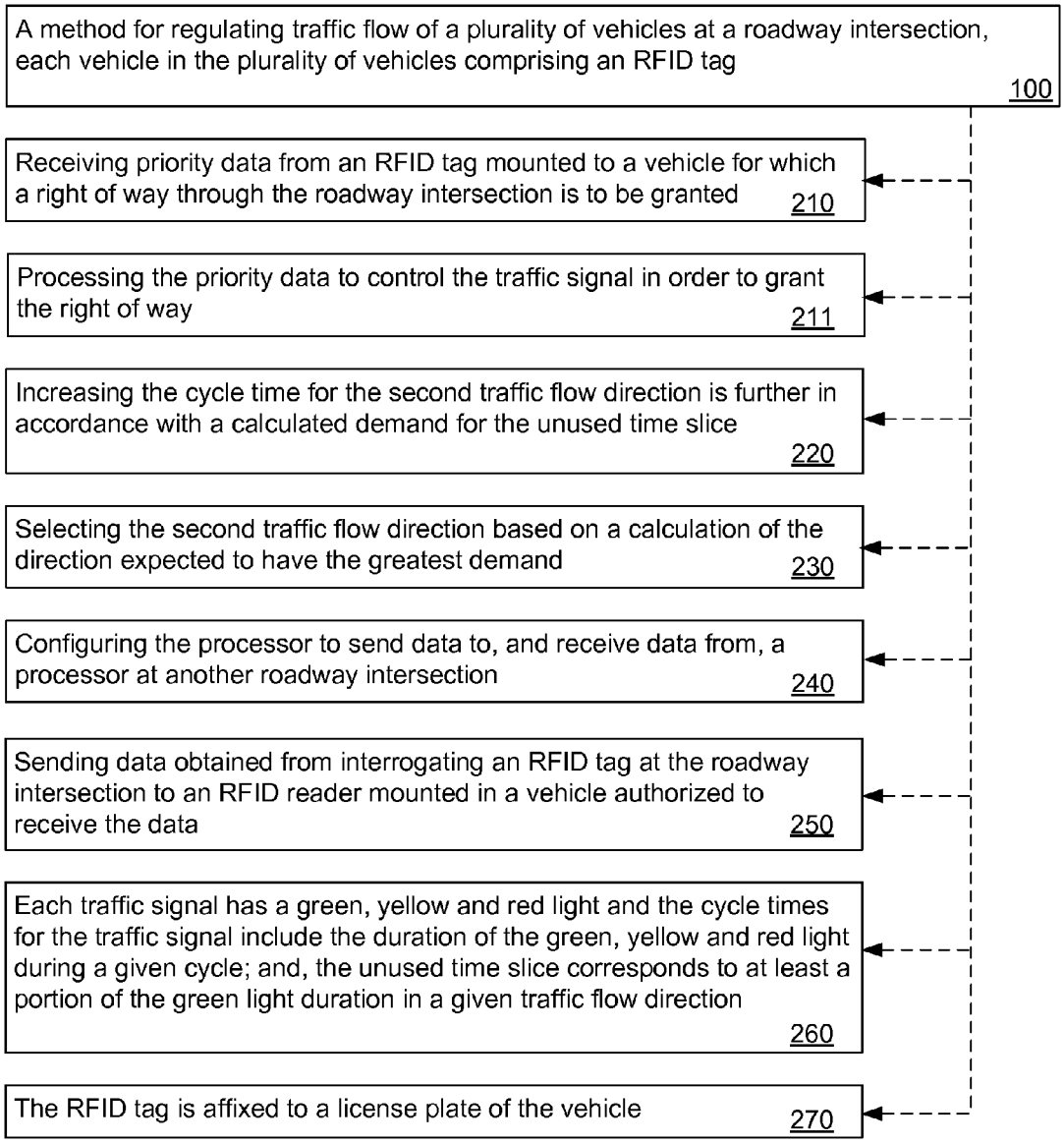
FIG. 2 is a diagram of optional limitations and steps for preferred methods of the invention

Regarding FIG. 2, a first optional limitation (210) includes additional steps of: receiving priority data from an RFID tag mounted to a vehicle for which a right of way through the roadway intersection is to be granted; and, a second optional limitation (211) includes processing the priority data to control the traffic signal in order to grant the right of way. This is the alternative embodiment in which the processor takes into consideration any priority given to emergency, police or other vehicles.

A second optional limitation (220) is wherein increasing the cycle time for the second traffic flow direction is further in accordance with a calculated demand for the unused time slice. This embodiment employs the processor in further calculations to allocate the unused time slice based on a calculation of demand for more time in the other direction. For example, data on the flow of traffic at various times of the day may be used to influence the actual extra time allocated to vehicles in the second traffic flow direction. Such calculation may involve adding sufficient time to a signaling direction for the oncoming vehicles to stop at the time of switching. Approaching vehicles may be detected by installing an RFID reader in the vicinity of the traffic signal but at a distance in front of the traffic signal. Approaching vehicles may also be detected by the processor receiving a communication from another processor installed at a nearby traffic signal so as to function in tandem, or in coordination with each other.

A third optional limitation (230) is wherein the second traffic flow direction is selected based on a calculation of the direction expected to have the greatest demand. For example, the optimal flow of traffic through the intersection may be based on expected demand for traffic flow in that direction. For example, when three or more directions are involved, the processor may calculate and select the next travel flow direction that is allocated all or a portion of unused time slice.

A fourth optional limitation (240) is wherein the processor is further configured to send data to, and receive data from, a processor at another roadway intersection. For example, this embodiment would be used when seeking to coordinate the sequence of lights along a particular direction of traffic flow. When the next intersection has a red light, it may not be most efficient to enable traffic flow in that direction when the traffic will be stopped and unable to transit the next intersection. This embodiment enables the processor to not only allocate the unused time slice, but to do so by factoring in expected traffic flow due to the traffic lights at other intersections.

A fifth optional limitation (250) adds a step of sending data obtained from interrogating an RFID tag at the roadway intersection to an RFID reader mounted in a vehicle authorized to receive said data. For example, this embodiment would be used to provide police vehicles with time and direction information on passage of a specific vehicle transiting the intersection.

A sixth optional limitation (260) is wherein each traffic signal comprises a green, yellow and red light and the cycle times for the traffic signal include the duration of the green, yellow and red light during a given cycle; and, wherein the unused time slice corresponds to at least a portion of the green light duration in a given traffic flow direction. This embodiment describes the usual traffic signal lighting scheme and specifically covers allocating a portion of the unused time slice to the green light.

A seventh optional limitation (270) is wherein the RFID tag is affixed to a license plate of the vehicle. The invention has its best use when all vehicles authorized to be on the road are outfitted with an RFID tag. The simplest implantation of this is by having all license plates issued with an RFID tag. While out of state vehicles may not be so equipped, such a practice would address the vast majority of cars.

The apparatus of the invention is a system for regulating the flow of traffic at a roadway intersection and contains the component parts necessary to perform the method of the invention.

Figure 4:
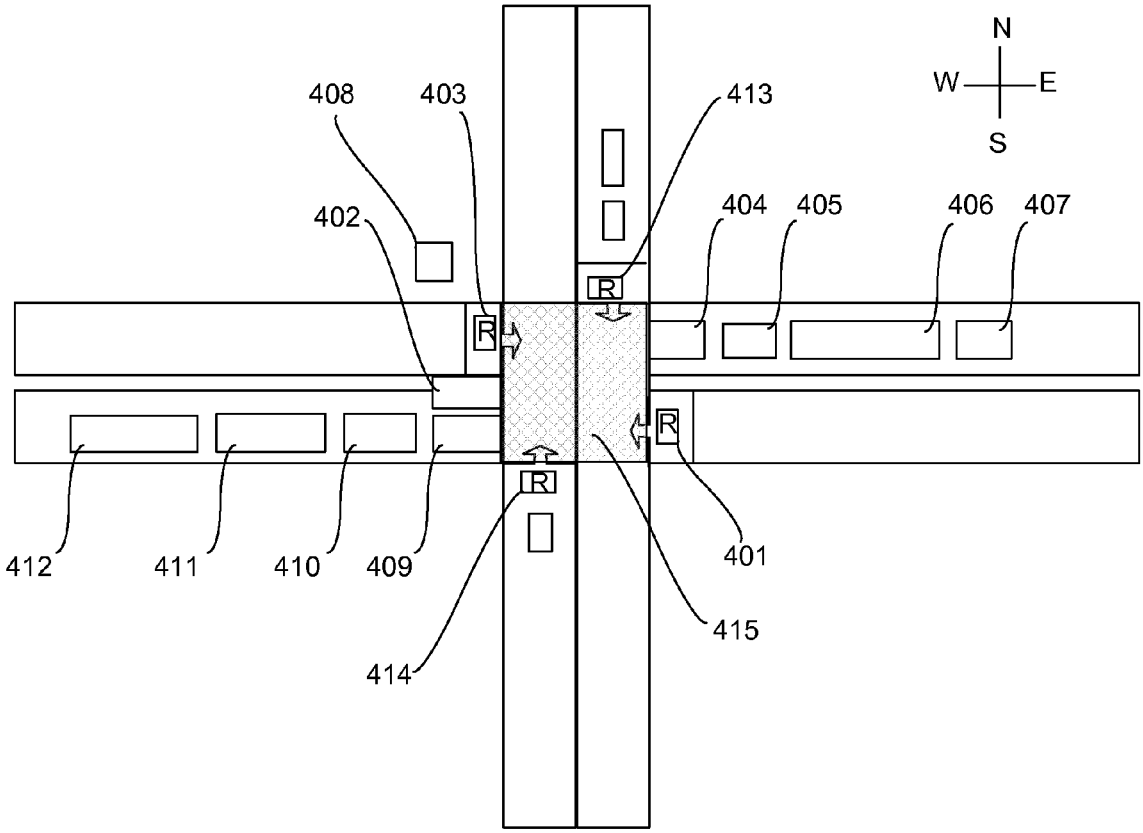
FIG. 4 illustrates the general architecture of the traffic signal switching system.

In regard to FIG. 4, the system comprises a processor (408) positioned in the vicinity of the roadway intersection (415), which is shown as the cross-hatched area. The roadway intersection comprises a traffic signal (401). A typical roadway will have more than one traffic signal and these are illustrated in FIG. 4 (403, 413, and 414). For simplicity of discussion, only one traffic signal (401) is referenced, but, preferably, all of the traffic signals (401, 403, 413 and 414) would be configured similarly.

The traffic signal (401) cycles traffic flow in a plurality of traffic flow directions through the roadway intersection (415), wherein the processor (408) is configured to store adaptable cycle times for the traffic signal (401).

The system further comprises an RFID reader (R) mounted in the vicinity of the traffic signal (401). Similarly, the same letter (R) is used to designate to an reader RFID reader in the vicinity of traffic signals (403, 413 and 414). The RFID reader (R) is configured to communicate with the processor (408).

The system further comprises an RFID tag (402) mounted on a vehicle configured to be interrogated by the RFID reader (C) when at the roadway intersection (415).

The processor (408) is further configured to respond to data received by the RFID reader (R) at least four ways, to: 1) count the number of RFID-tagged vehicles present in all of the traffic flow directions at the roadway intersection (415); 2) calculate an unused time slice of the cycle time for a first traffic flow direction at the roadway intersection (415); 3) reduce the cycle time for the first traffic flow direction in accordance with the unused time slice; and, 4) increase the cycle time for a second traffic flow direction at the roadway intersection (415) in accordance with the unused time slice.

Example 1

Process: Scenario without the Invention

FIG. 4 illustrates an intersection (415) with multiple traffic signals (403), (413), (401), and (414) controlling multiple directions of travel through the intersection (415). The traffic regulation process that would occur in the absence of the present invention involves control of the intersection (415) by a traffic signal (401) that allocates 30 seconds for a vehicle to make a left turn. While traffic signal (401) is green for a left turn, traffic signal (403) is red to prevent traffic flow from crossing the travel direction of any left turning vehicles. After the vehicle with an RFID tag (402) completes a left turn at the intersection (415), 25 seconds remain unused, and the traffic signal (401) remains green for additional cars to make a left turn, if any were present. When the 25 seconds expires, the traffic signal (401) switches to red for a left turn direction and the traffic signal (403) switches to green in the crosswise direction to let the vehicles to pass.

Example 2

Process: Scenario with the Invention

In regard to FIG. 4, traffic signals (403), (413), (401), and (414) contain signal RFID readers (R). The processor (408) is at the side of the roadway near the intersection (415).

Vehicles with RFID tags (404), (405), (406), and (407) are traveling west (to the left); and the vehicle (402) is a vehicle traveling east (to the right) and turning left at the signal.

Traffic signal (401) containing RFID reader (R) allocates 30 seconds for the vehicle (402) to make a left turn. When the traffic signal (401) containing RFID reader (R) finds no vehicles in the middle lane, then, the traffic signal (403) containing RFID reader (R), which is the direction that would be authorized to advance in next sequence for the traffic signal, reads and calculates that there are four vehicles (404, 405, 406 and 407) waiting to advance through the intersection (415) in that direction.

The processor (408) is provided with the information from signal RFID readers (R) at traffic signals (401 and 403). RFID readers (R) are preferably installed in every direction of the traffic signal, so as to provide greater confidence that all the RFID-equipped vehicles in every direction at the intersection will be detected.

The processor (408) calculates that there is an unused 25 seconds time slice with no vehicles waiting for a left turn, and then switches the traffic signals (403 and 401) containing RFID readers (R) to "green" to let vehicles (404, 405, 406, 407, 409, 410, 411, and 412) to pass, since the traffic is more in the east-west directions than in the north-south directions. This is an extra switching activity that in the absence of the invention would not take place. The traffic signals (413 and 414) containing RFID readers (R) are thereafter activated in their regular allocated time. The extra switching activity reduces the traffic congestion at that intersection (415).

In contrast, the sequence of events is different when the intersection (415) is controlled by a conventional traffic signal, which would only check the middle lane only at the time of switching, not after the switching. It is also different in that the unused time slice is allocated to the most wanted direction, not to the next signal in sequence.

In normal operational mode of the invention, vehicles equipped with an RFID tag will not receive any data from the processor (408). Thus, any traffic signal cannot be influenced by any other source except the count and the priority index of the vehicles. In this mode, the data processed by the processor (408) is not broadcasted to any external systems.

Figure 3:
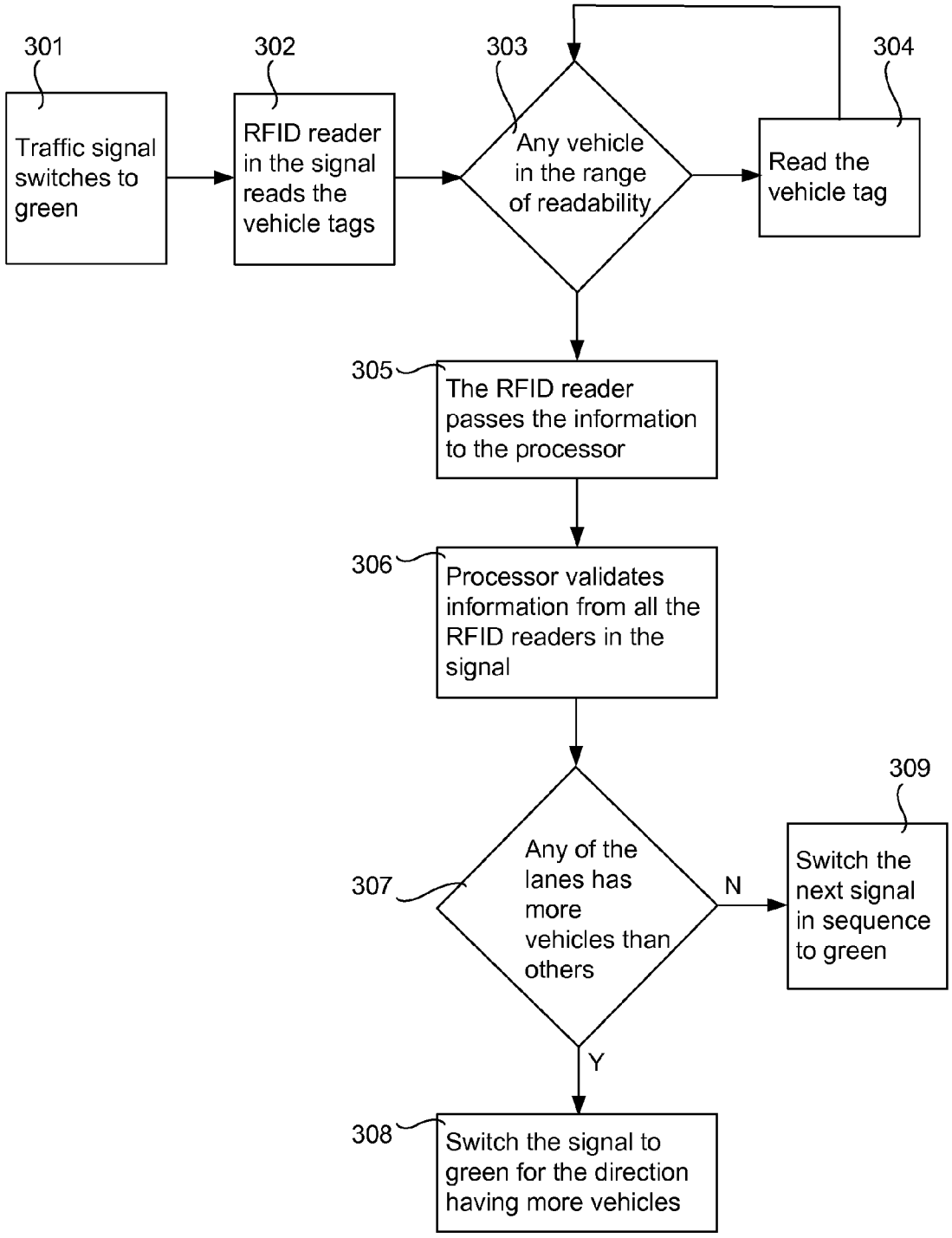
FIG. 3 is a flowchart illustrating steps in a method of the traffic signal switching system.

FIG. 3 illustrates a method of the invention, for example, a traffic signal switches to green (301); the RFID reader in the signal reads the vehicle tags (302); when a vehicle is in the range of readability (303), the signal reads the vehicle tag (304); the RFID reader passes the information to the processor (305); the processor validates information from all the RFID readers in the signal (306); when any of the lanes has more vehicles than others (307), switch the signal to green for the direction having more vehicles (308); or switch the next signal in sequence to green (309).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the traffic control industry and to all industries using roads controlled by a traffic signal.

What is claimed is:

1. A method for regulating traffic flow of a plurality of vehicles at a roadway intersection, each vehicle in the plurality of vehicles comprising an RFID tag, the method comprising the steps of:

positioning a processor in the vicinity of the roadway intersection, said roadway intersection comprising a traffic signal that cycles vehicle flow in a plurality of traffic flow directions through the roadway intersection;

storing adaptable cycle times for the traffic signal in the processor;

mounting an RFID reader in the vicinity of the traffic signal, wherein the RFID reader is configured to communicate with the processor;

interrogating with the RFID reader an RFID tag on each vehicle in the plurality of vehicles to count the number of RFID tags present in each traffic flow direction at the roadway intersection;

calculating an unused time slice of the cycle time for a first traffic flow direction at the roadway intersection;

reducing the cycle time for the first traffic flow direction in accordance with the unused time slice; and, increasing the cycle time for a second traffic flow direction at the roadway intersection in accordance with the unused time slice.

2. A method as recited in claim 1, further comprising the steps of: receiving priority data from an RFID tag mounted to a vehicle for which a right of way through the roadway intersection is to be granted; and, processing the priority data to control the traffic signal in order to grant the right of way.

3. A method as recited in claim 1, wherein increasing the cycle time for the second traffic flow direction is further in accordance with a calculated demand for the unused time slice.

4. A method as recited in claim 1, further comprising the step of selecting the second traffic flow direction based on a calculation of the direction expected to have the greatest demand.

5. A method as recited in claim 1, further comprising the step of configuring the processor to send data to, and receive data from, a processor at another roadway intersection.

6. A method as recited in claim 1, wherein each traffic signal comprises a green, yellow and red light and the cycle times for the traffic signal include the duration of the green, yellow and red light during a given cycle; and, wherein the unused time slice corresponds to at least a portion of the green light duration in a given traffic flow direction.

7. A method as recited in claim 1, wherein the RFID tag is affixed to a license plate of the vehicle.

8. A system for regulating the flow of vehicles at a roadway intersection, comprising:

a processor positioned in the vicinity of the roadway intersection, said roadway intersection comprising a traffic signal that cycles traffic flow in a plurality of traffic flow directions through the roadway intersection, wherein the processor is configured to store adaptable cycle times for the traffic signal;

an RFID reader mounted in the vicinity of the traffic signal, wherein the RFID reader is configured to communicate with the processor; and, an RFID tag mounted on each vehicle configured to be interrogated by the RFID reader when at the roadway intersection, the RFID tag thereby sending data to the RFID reader;

wherein the processor, in response to data received by the RFID reader from each RFID tag interrogated by the RFID reader, is further configured to:

count the number of RFID-tagged vehicles present in all of the traffic flow directions at the roadway intersection;

calculate an unused time slice of the cycle time for a first traffic flow direction at the roadway intersection;

reduce the cycle time for the first traffic flow direction in accordance with the unused time slice; and, increase the cycle time for a second traffic flow direction at the roadway intersection in accordance with the unused time slice.

* * * * *